US005508587A

United States Patent [19]

Williams et al.

[11] Patent Number: 5,508,587

[45] Date of Patent: Apr. 16, 1996

[54] INCANDESCENT LAMP USE WITH AN OPTICAL FIBER

[76] Inventors: Ronald R. Williams, 24872 Sea Aire, Dana Point, Calif. 92629; Jay E. Philippbar, 2006 Via Solona, San Clemente, Calif. 92672

[21] Appl. No.: 974,732

[22] Filed: Nov. 13, 1992

[51] Int. Cl.[6] ..... H01K 1/28; H01K 7/00

[52] U.S. Cl. ..... 313/578; 313/271; 313/113; 313/573; 362/310; 362/341; 385/117

[58] Field of Search ..... 313/279, 578, 313/634, 315, 317, 580, 110, 113, 318, 271, 573; 140/71.5, 71.6; 362/226, 296, 310, 341; 385/117

[56] References Cited

U.S. PATENT DOCUMENTS

| | | | |
|---|---|---|---|
| 1,547,747 | 7/1925 | Grogan | 313/315 X |
| 1,859,601 | 5/1932 | Rice | 313/315 X |
| 1,983,362 | 12/1934 | Geiger et al. | 313/315 X |
| 2,454,765 | 11/1948 | Braunsdorff | 313/315 X |
| 4,160,929 | 7/1979 | Thorington et al. | 313/315 X |
| 4,178,050 | 12/1979 | Kiesel et al. | 445/27 |
| 4,243,907 | 1/1981 | Kohl et al. | 313/315 X |
| 4,322,783 | 3/1982 | Chappell et al. | 313/318 X |
| 4,330,274 | 5/1982 | Friedman et al. | 362/804 |
| 4,338,540 | 7/1982 | Sovilla | 313/112 X |
| 4,785,383 | 11/1988 | Tarnay | 362/296 X |
| 4,918,354 | 4/1990 | Johnson, Jr. | 313/279 |
| 4,935,662 | 6/1990 | Kachenmeister, Jr. et al. | 313/279 |
| 4,937,496 | 6/1990 | Neiger et al. | 313/637 X |

FOREIGN PATENT DOCUMENTS

| | | | |
|---|---|---|---|
| 1017828 | 1/1966 | United Kingdom | 313/315 |

*Primary Examiner*—Sandra L. O'Shea
*Assistant Examiner*—Ashok Patel
*Attorney, Agent, or Firm*—W. Edward Johansen

[57] ABSTRACT

An incandescent lamp includes a base, a first stiff lead-in wire and a second stiff lead-in wire, a connector, a filament and a non-opaque tubular envelope. The base is formed out of a non-conductive material. The first and second stiff lead-in wires, respectively, extend from the base. The connector is electrically coupled to the first and second stiff lead-in wires and mechanically coupled to the base. The filament has a first end and a second end which are electrically coupled to the first and second lead-in wires, respectively. The filament is formed out of a conductive wire in the shape which provides a radiation area which is similar to the illumination area of the bundle of optical fibers so that the radiation fills the illumination area within the geometric boundaries imposed. The non-opaque tubular envelope has an open end and a closed end and is mechanically coupled to the base at the open end. The base press-seals the non-opaque tubular envelope to form an enclosed chamber.

4 Claims, 2 Drawing Sheets

INCANDESCENT LAMP USE WITH AN OPTICAL FIBER

BACKGROUND OF THE INVENTION

The field of the invention is filaments for use in an incandescent lamp.

U.S. Pat. No. 4,243,907 teaches a tungsten halogen lamp which has a tubular envelope of quartz. The tubular envelope has a press-seal at one end is reduced in width by the removal of right-angled sections from opposite lower corners of the press-seal. The tungsten halogen lamp includes a ceramic base having a slot with closed ends for accommodating the reduced width portion of the press-seal.

U.S. Pat. No. 4,322,783 teaches a tungsten halogen exposure lamp which has a tubular envelope of quartz which has a pinch seal at each end with a pair of stiff lead-in wires respectively extending therefrom.

U.S. Pat. No. 4,918,354 teaches a compact fine wire incandescent lamp coiled-coil filament which is compact and has structural rigidity. There is minimal sag when the filament is incorporated into an incandescent lamp of the tungsten halogen type variety.

U.S. Pat. No. 4,935,662 teaches an electric lamp which has a coiled filament and at least one intermediate filament support which effectively restrains the filament from excessive swaying or sagging. The support effectively restrains filament movement in directions along and normal to the filamentary axis.

U.S. Pat. No. 4,937,496 teaches a xenon short arc discharge lamp which has a lamp bulb of quartz into which two rod-shaped electrodes protrude. The spacing of the two rod-shaped electrodes is shorter than the diameter of the shaft of the cathode.

U.S. Pat. No. 4,330,274 teaches a lamp assembly which includes a conductive block having a plurality of longitudinal passageways extending from one end of the block adjacent the proximal end of a handpiece in a configuration matching the fluid transmitting conduit configuration extending from the handpiece and terminating at the opposite end of the block. The passageways at the opposite end are connected to an air/water supply tubing. The lamp assembly is removably coupled to the handpiece. The block has a cavity for housing a miniature halogen bulb with the halogen bulb longitudinally seated therein. The halogen bulb is detachably engaged in the cavity such that the halogen bulb may be removed for replacement without disturbing the fluid interface between the block and the air/water supply tubing. The halogen bulb has a light transmitting end in close optical coupling with the proximal end of the handpiece. The halogen bulb is directed into a bundle of optical fibers and is removably attached to the handpiece.

U.S. Pat. No. 4,178,050 teaches a bulb of hard glass which permits the use of hard glass rather than silica or quartz glass. The exhaust tube is molded on adjacent the rounded-off bulb. A mount assembly composed of filaments and two or more lead-in wires is pinch-sealed into the bulb such that pre-oxidized portions of the lead-in wires come to lie within the pinch seal. The pinch seal is rendered vacuum-tight and shaped in separate steps including repeated heating to fuse the wires to the glass and to shape the pinch seal. Subsequent to filling with inert gas, the lamp manufacture is terminated by tipping off the exhaust tube.

U.S. Pat. No. 4,338,540 teaches an incandescent halogen lamp which includes an inner glass bulb which is a thick-walled quartz glass bulb which acts as a heat-storer and heat radiation reflector and closely surrounds the filament so that losses of energy by thermal convection and radiation are strongly reduced leading to an optimum luminous efficiency.

U.S. Pat. No. 4,785,383 teaches a molded glass reflector member for a lamp unit employing a tungsten halogen lamp as the light source. The engagement mechanism mounts the lamp unit replaceably in a socket member and includes a particular configuration of the hollow cavity portion of the reflector member to enable improved lamp focus and physical retention of the lamp unit in its socket.

SUMMARY OF INVENTION

The present invention is generally directed to an incandescent lamp including a filament, a base, a pair of stiff lead-in wire extending from the base and electrically coupling the filament to a connector, and a non-opaque tubular envelope having an open end and a closed end. The base press-seals the non-opaque tubular envelope to form an enclosed chamber. The filament provides a radiation area which is similar to an illumination area of a bundle of optical fibers so that the radiation fills the illumination area within the geometric boundaries imposed. The radiation area and the illumination area are perpendicular to an active axis.

In a first aspect of the present invention, the filament, when viewed perpendicularly with respect to the active axis, will have proper geometric placement to reduce spherical aberration induced by the imaging lens resulting in a decreased spot diameter on the imaged plane.

In a second aspect of the present invention, the filament is in the shape of an inverted truncated cone.

In a third aspect of the present invention, the filament is in the shape of a sphere.

In a fourth aspect of the present invention, a reflector is used with the filament to gather additional light energy emitted from the sides of the filament and directs this light energy toward the desired illumination area on the imaged plane.

In a fifth aspect of the present invention, a focusing lens is integrally incorporated into the closed end of the non-opaque tubular envelope.

In a sixth aspect of the present invention, an external focusing lens is disposed in front of the closed end of the non-opaque tubular envelope.

Other aspects and many of the attendant advantages will be more readily appreciated as the same becomes better understood by reference to the following detailed description and considered in connection with the accompanying drawing in which like reference symbols designate like parts throughout the figures.

The features of the present invention which are believed to be novel are set forth with particularity in the appended claims.

DESCRIPTION OF THE PREFERRED EMBODIMENTS

Figure 1:
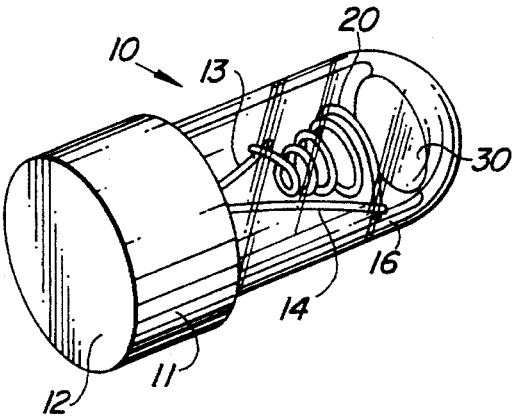
FIG. 1 is a perspective drawing view of an incandescent lamp which includes a filament in accordance with the first embodiment.
Figure 2:
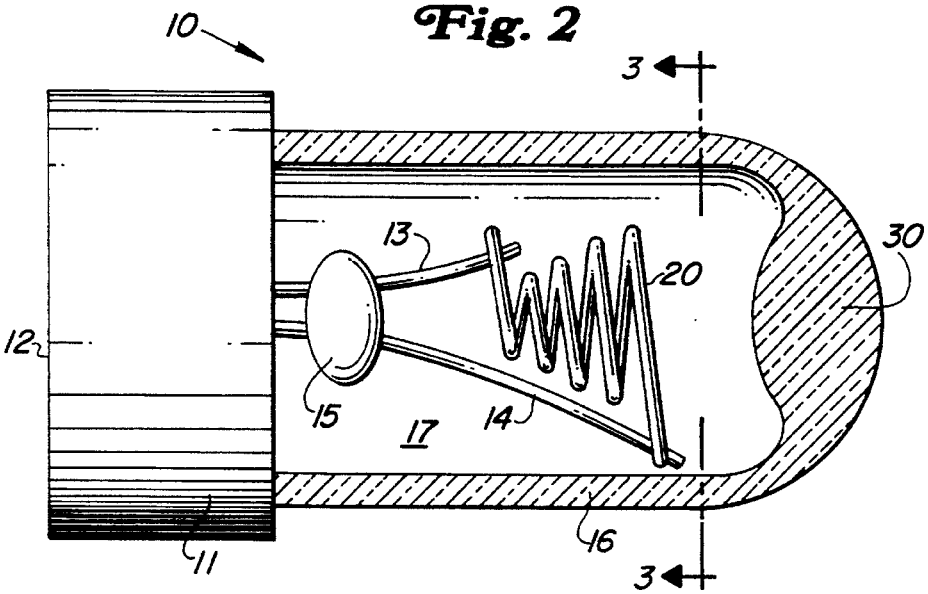
FIG. 2 is an elevational view in cross-section of the incandescent lamp of FIG. 1.

Referring to FIG. 1 in conjunction with FIG. 2 an incandescent lamp 10 includes a base 11, a connector 12, a first stiff lead-in wire 13, a second stiff lead-in wire 14, a spacer 15, a non-opaque tubular envelope 16 and an inert gas 17. The base 11 is formed out of a non-conductive material such as a ceramic material. The first and second stiff lead-in wires 13 and 14, respectively, extend from the base 11. The connector 12 is mechanically coupled to the base 11. The spacer 15 keeps the first and second stiff lead-in wires 13 and 14 apart from each so that they do not short out the incandescent lamp 10. The non-opaque tubular envelope 16 having an open end and a closed end is mechanically coupled to the base 11 at the open end. The inert gas 17 fills the non-opaque tubular envelope 16. The inert gas may be one of the following gases, one of the halogens, argon, nitrogen, krypton and radon. The base 11 press-seals the non-opaque tubular envelope 16. The non-opaque tubular envelope 16 may be formed out of quartz. The incandescent lamp 10 also includes a filament 20 which is formed out of a conductive wire in the shape of an inverted truncated cone and has a first end and a second end. The conductive wire may be formed out of tungsten. The first and second lead-in wires 13 and 14 electrically couple the connector 12 to the first and second ends, respectively, of the filament 20.

Figure 3:
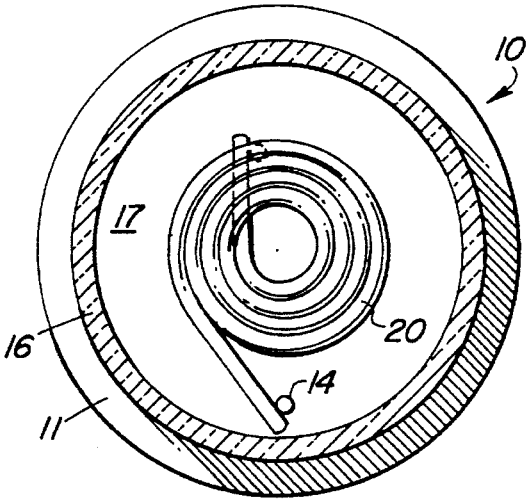
FIG. 3 is a cross-sectional view of the incandescent lamp of FIG. 1 taken along the line 3—3 of FIG. 2.

Referring to FIG. 3 the filament 20, when viewed from the active axis, duplicates an area similar to that of the illumination area of a bundle of optical fibers in order to fill the illumination area thereof within the geometric boundaries imposed thereby. The filament 20, when viewed perpendicularly with respect to the active axis, will have proper geometric placement to reduce spherical aberration induced by the imaging lens resulting in a decreased spot diameter on the imaged plane.

Figure 4:
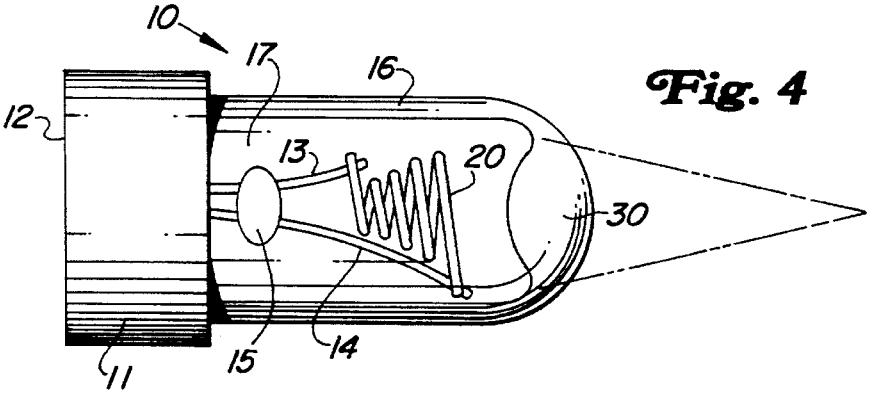
FIG. 4 is an elevational view in cross-section of the incandescent lamp of FIG. 1.

Referring to FIG. 4 in conjunction with FIG. 2 the incandescent lamp 10 further includes a focusing lens 30 The focusing lens 30 is integrally incorporated into the closed end of the non-opaque tubular envelope 16. In an alternate embodiment an external focusing lens may also be disposed in front of the closed end of the non-opaque tubular envelope 16.

Figure 5:
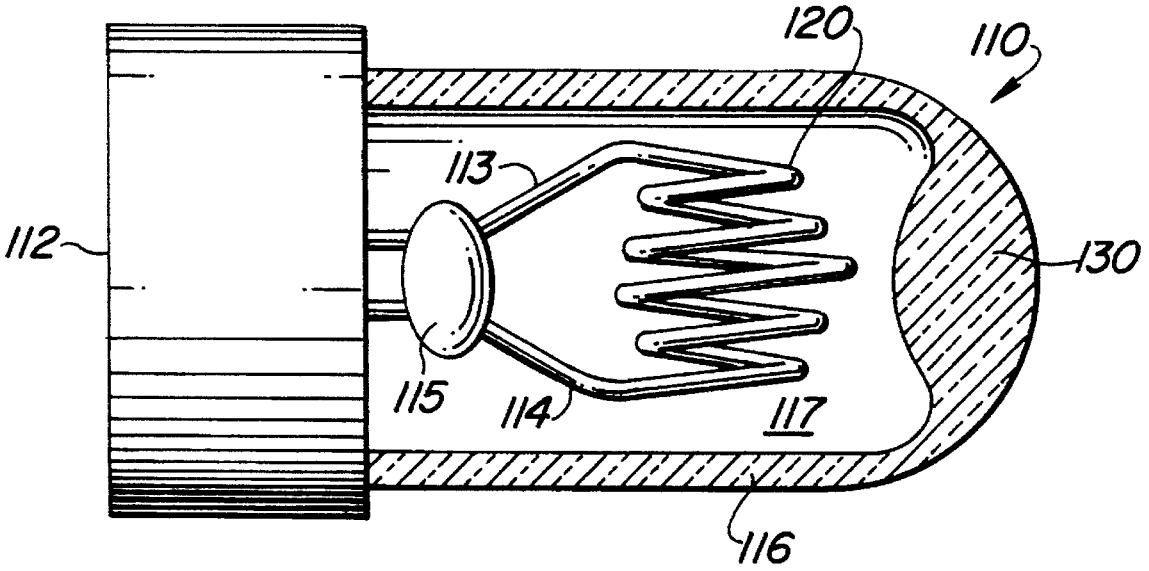
FIG. 5 is an elevational view in cross-section of an incandescent lamp of FIG. 1 which includes a filament in accordance with the second embodiment.

Referring to FIG. 5 an incandescent lamp 110 includes a base 111, a connector 112, a first stiff lead-in wire 113, a second stiff lead-in wire 114, a spacer 115, a non-opaque tubular envelope 116 and an inert gas 117. The base 111 is formed out of a non-conductive material such as a ceramic material. The first and second stiff lead-in wires 113 and 114, respectively, extend from the base 111. The connector 112 is mechanically coupled to the base 111. The spacer 115 keeps the first and second stiff lead-in wires 113 and 114 apart from each so that they do not short out the incandescent lamp 110. The non-opaque tubular envelope 116 having an open end and a closed end is mechanically coupled to the base 111 at the open end. An inert gas 117 fills the non-opaque tubular envelope 116. The base 111 press-seals the non-opaque tubular envelope 116. The incandescent lamp 110 also includes a filament 120 which is formed out of a conductive wire in the shape of a sphere and has a first end and a second end. The first and second stiff lead-in wires 113 and 114 electrically couple the connector 112 to the first and second ends, respectively, of the filament 120. A focusing lens 130 is integrally incorporated into the closed end of the non-opaque tubular envelope 116.

Figure 6:
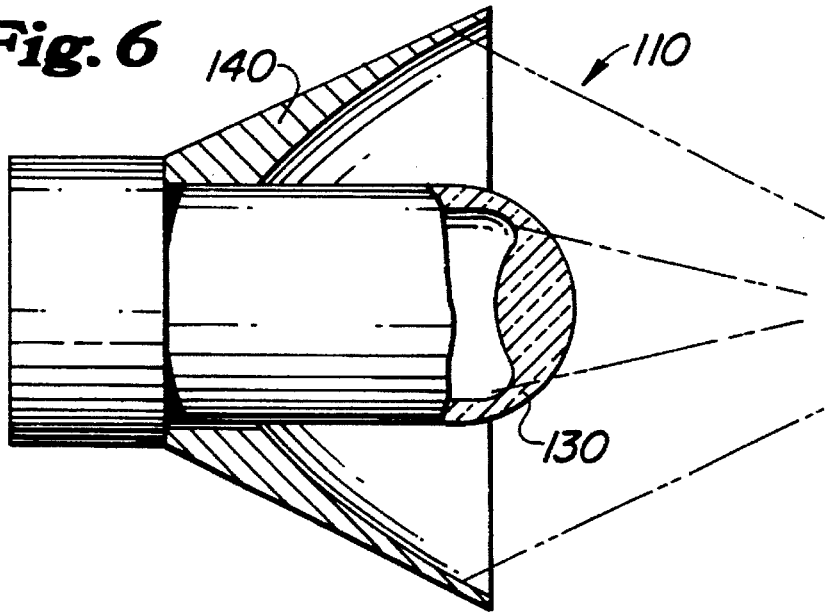
FIG. 6 is an elevational view in partial cross-section of an incandescent lamp of FIG. 1 which includes a reflector in accordance with the third embodiment.

Referring to FIG. 6 in conjunction with FIG. 5 the incandescent lamp 110 further includes a reflector 140. The reflector 140 is used to gather additional light energy emitted from the sides of the filament 120 and directs this light energy toward the illumination area on an imaged plane.

From the foregoing it can be seen that filaments for use in an incandescent lamp have been described. It should be noted that the sketches are not drawn to scale and that distance of and between the figures are not to be considered significant.

Accordingly it is intended that the foregoing disclosure and showing made in the drawing shall be considered only as an illustration of the principle of the present invention.

What is claimed is:

1. An incandescent lamp comprising:

a. a base which is formed out of a non-conductive material;

b. a first stiff lead-in wire and a second stiff lead-in wire both of which respectively extending from said base;

c. a connector electrically coupled to said first and second stiff lead-in wires and mechanically coupled to said base;

d. a filament having a first end and a second end which are electrically coupled to said first and second lead-in wires, respectively, said filament being formed out of a conductive wire in the shape of an inverted truncated cone in order to provide radiation which fills the illumination area of the bundle of optical fibers within the geometric boundaries imposed;

e. a non-opaque tubular envelope having an open end and a closed end mechanically coupled to said base at said open end;

f. an inert gas fills said non-opaque tubular envelope whereby said base press-seals said non-opaque tubular envelope; and g. an integral focusing lens incorporated into said closed end of said non-opaque tubular envelope.

2. An incandescent lamp according to claim 1 wherein said incandescent lamp includes a reflector used to gather additional light energy emitted from the sides and rear of said filament and directs it toward the desired illumination area on an imaged plane.

3. An incandescent lamp comprising:

a. a base which is formed out of a non-conductive material;

b. a first stiff lead-in wire and a second stiff lead-in wire both of which respectively extending from said base;

c. a connector electrically coupled to said first and second stiff lead-in wires and mechanically coupled to said base;

d. a filament having a first end and a second end which are electrically coupled to said first and second lead-in wires, respectively, said filament being formed out of a conductive wire in the shape of a sphere in order to provide radiation which fills the illumination area of the bundle of optical fibers within the geometric boundaries imposed;

e. a non-opaque tubular envelope having an open end and a closed end mechanically coupled to said base at said open end;

f. an inert gas fills said non-opaque tubular envelope whereby said base press-seals said non-opaque tubular envelope; and g. an integral focusing lens incorporated into said closed end of said non-opaque tubular envelope.

4. An incandescent lamp according to claim 3 wherein said incandescent lamp includes a reflector used to gather additional light energy emitted from the sides and rear of said filament and directs it toward the desired illumination area on an imaged plane.

* * * * *